US005772569A

United States Patent [19]

Janhonen

[11] Patent Number: 5,772,569

[45] Date of Patent: Jun. 30, 1998

[54] METHOD AND APPARATUS FOR THE CONTINUOUS PRODUCTION OF PACKAGE BLANKS

[75] Inventor: Veikko Janhonen, Helsinki, Finland

[73] Assignee: Pussikeskus OY, Helsinki, Finland

[21] Appl. No.: 607,287

[22] Filed: Feb. 26, 1996

[30] Foreign Application Priority Data

Feb. 28, 1995 [FI] Finland ..... 950921

[51] Int. Cl.[6] ..... B61B 3/00; B65B 11/00; B65B 25/14

[52] U.S. Cl. ..... 493/333; 493/93; 493/128; 493/131; 493/151; 493/334; 493/335

[58] Field of Search ..... 493/6, 22, 49, 493/95, 110, 111, 128, 139, 131, 148, 150, 151, 229, 264, 328, 331, 333, 332, 334, 335, 355, 93, 942, 455, 379, 380, 381, 922, 94, 386, 393

[56] References Cited

U.S. PATENT DOCUMENTS

| | | | |
|---|---|---|---|
| 2,166,388 | 7/1939 | Bergstein . | |
| 2,429,482 | 10/1947 | Munters | 493/335 |
| 3,052,588 | 6/1962 | Anderson | 493/334 |
| 3,179,023 | 4/1965 | Hoff | 493/335 |
| 3,878,771 | 4/1975 | Malcolm . | |
| 3,986,440 | 10/1976 | Macdonald | 493/6 |
| 4,325,507 | 4/1982 | Janhonen . | |
| 4,589,552 | 5/1986 | Chevalier . | |
| 4,600,346 | 7/1986 | Podosek | 493/110 |
| 4,757,666 | 7/1988 | Janhonen | 53/176 |
| 4,849,043 | 7/1989 | Instance | 493/335 |
| 4,931,035 | 6/1990 | Schmidt | 493/381 |
| 4,997,504 | 3/1991 | Wood | 493/333 |
| 5,097,651 | 3/1992 | Decottignies et al. . | |
| 5,205,651 | 4/1993 | Decottignies et al. . | |

*Primary Examiner*—Joseph J. Hail, III
*Assistant Examiner*—Christopher W. Day
*Attorney, Agent, or Firm*—Price, Heneveld, Cooper, Dewitt & Litton

[57] ABSTRACT

The invention relates to a method and apparatus the continuous production of package blanks. The package blank is intended for delivering books by mail and it is fabricated by drawing from a roll, a web of cardboard (1*w*), having a surface which is coated with adhesive zones (19) at distances corresponding to the length of a blank. A stud-chain conveyor (14) driven in synchronization with a cardboard-web (1*w*) chopping device supplies the adhesive zones (19) with paper strips (2*p*) forming an inner wrapper for the package.

13 Claims, 2 Drawing Sheets

METHOD AND APPARATUS FOR THE CONTINUOUS PRODUCTION OF PACKAGE BLANKS

BACKGROUND OF THE INVENTION

The present invention relates to a method for the continuous production of package blanks, wherein a web of cardboard is continuously drawn from a roll, the web of cardboard is guided through a pair of slotted cylinders for providing the web with a mild corrugation, lengthwise scoring lines are made at a small distance from both edges of the web, lengthwise adhesive strips are applied adjacent to the scoring lines, and the web edges are double-folded along the scoring lines.

The invention relates also to an apparatus for the continuous production of package blanks. The apparatus comprises a roll housing for a web of cardboard, a pair of slotted cylinders for passing the web of cardboard therethrough in a mildly meandering fashion, a pair of cylinders fitted with scoring discs for producing lengthwise scoring lines adjacent to the edges of the web of cardboard, an adhesive station for applying an adhesive adjacent to the scoring lines, a folding shoe for bending the web edges along the scoring lines, a pair of press cylinders for pressing the doubled edges of the web of cardboard to the adhesive layer, a main drawing device included in the downstream end of the web of cardboard for continuously drawing the web of cardboard, and a cut-off device downstream of the main drawing device for chopping the web of cardboard to package blanks of a suitable length.

A method and apparatus of the above type have been described in the Applicant's Patent publication EP 0,512,355. In that publication, the final package blank is completely made of the material of a web of cardboard. The use of material is not optimal since one side of a finished package will be provided with a triple cardboard layer (in places even quintuple) and the other side of the finished package will be provided with just a single cardboard layer.

SUMMARY OF THE INVENTION

An object of the invention is to provide an improved method and apparatus capable of producing continuously and at a high production capacity from two different materials, namely cardboard and paper, a package blank which is optimal in terms of material consumption and suitable for packing books of varying sizes firmly and protectively.

An additional object of the invention is to provide a method and apparatus enabling the use of a relatively thin, massive cardboard and which is pre-crimped, known methods of pre-crimping a package blank are set forth in Publication EP 0,512,355.

A method of the invention is characterized in that the surface of a continuous web of cardboard treated as described is coated with adhesive zones spaced apart at distances corresponding to the length of the package blanks to be produced, that the edge sections of a web of paper are folded on top of the mid-section such that the edge sections overlap on top of each other, that the web of paper folded as described is chopped to strips forming an inner wrapper for the package blank and delivered onto the web of cardboard in alignment with the adhesive zones while the web of cardboard is continuously drawn towards a main drawing device, and that the web of cardboard is chopped to precision-length package blanks at locations between the inner wrappers.

In view of landing the inner wrapper strips on proper spots at a high track speed, it is preferred that the supply and alignment of an inner wrapper strip and the alignment of an adhesive zone be controlled in synchronism with the action of a chopping device for the web of cardboard.

Although the inner wrapper strips can be made in a separate production process and fed from a bundle onto the web of cardboard, it is preferred that the web of paper be drawn from a roll in a continuous action in the same preparation machine as the web of cardboard, the latter being drawn at a speed more than 2 times that of the web of paper. This eliminates a separate handling process required for inner wrapper bundles.

An apparatus of the invention is characterized in that the apparatus further includes an adhesive nozzle downstream of a pair of press cylinders for the application of an adhesive onto the web of cardboard periodically so as to form adhesive zones at distances corresponding to the length of a package blank, and aligning and feeding means for delivering separate inner wrapper strips onto the web of cardboard in alignment with the adhesive zones.

In view of securing the feeding of inner wrapper strips to correct locations on the continuous web of cardboard, which travels at a high speed and will not be chopped until later, it is preferred that a transmission be provided from the cardboard-web chopping device to a stud-chain conveyor for delivering the inner wrapper strips in alignment with the adhesive zones.

BRIEF DESCRIPTION OF THE DRAWINGS

The invention will now be described in more detail with reference made to the accompanying drawings, in which.

DETAILED DESCRIPTION OF THE PREFERRED EMBODIMENT

Figure 4:
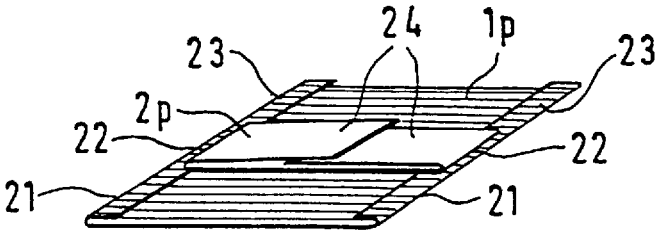
FIG. 4 shows a perspective view of a package blank fabricated with a method of the invention, comprising an outer cardboard 1*p* and an inner wrapper 2*p*.

FIG. 4 illustrates a package blank fabricated by means of a method and apparatus of the invention and suitable for delivering books of varying sizes by mail. A rectangularly shaped outer cardboard 1*p* is provided with double-folded edge sections 23 having folding lines 21 which define the side edges of a package blank. In the finished package, the edge reinforcements 23 protect and strengthen the end edges and corners of a package. The individual edge reinforcement 23 has a width which is 5–20%, preferably about 8–15%, of the width of a package blank. In the middle of the piece of cardboard 1*p* is secured with an adhesive a transversely directed inner wrapper 2*p*, having free ends which are overlapped on top of each other in the middle of the blank. The inner wrapper 2*p* is provided with folding lines 22 which remain inside the folding lines 21. In view of making the blank adaptable to books of varying sizes, it is essential that the inner wrapper 2*p* be made of paper instead of rigid cardboard. This type of package is known from the Patent publication U.S. Pat. No. 4,627,223. Since the package has proved highly versatile, an object of this invention is to provide a method and apparatus for producing such a package continuously and at a high production capacity.

Figure 1:
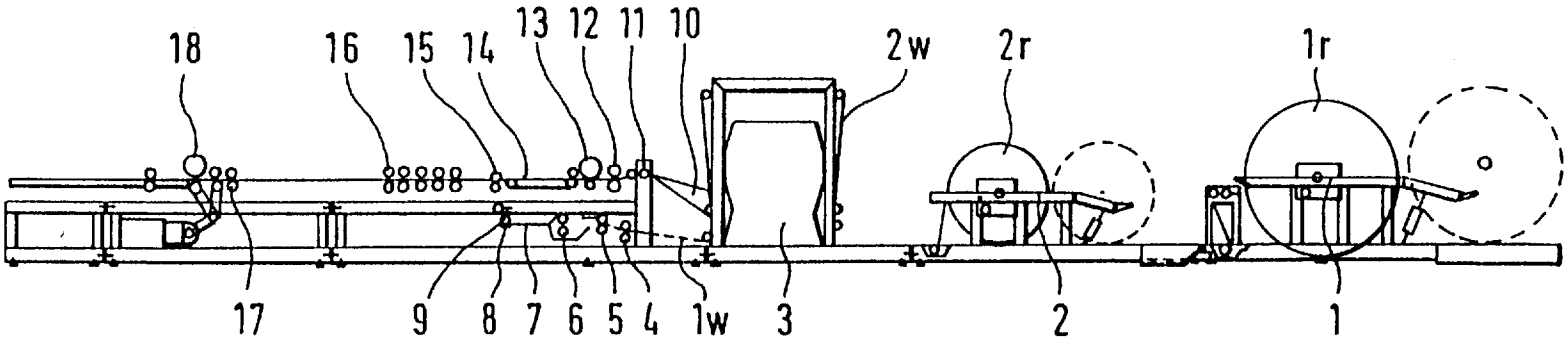
FIG. 1 shows a schematic side view of a machine for implementing the method.
Figure 1A:
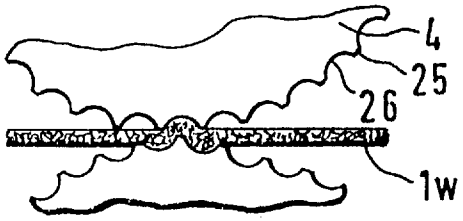
FIG. 1A shows a larger-scale view of a detail in the machine of FIG. 1, wherein a web of cardboard progresses through a pair of slotted crimping cylinders.

A roll housing 1 carries a roll of cardboard Ir for drawing a web of cardboard 1*w* therefrom. The cardboard consists of a compact solid pulp, having a thickness which is about 0.2–0.8 mm, preferably about 0.3–0.5 mm. The cardboard has a grammage which is about 200–600 g/m$^2$, preferably 250–500 g/m$^2$. If necessary, the web of cardboard is carried through a printing unit 3 for printing desired images and/or text on the cardboard surface. Next, the web of cardboard 1*w* is carried through slotted cylinders 4. As shown more accurately in FIG. 1A, the cylinders 4 are provided with meshing grooves 26 and ridges 25 for creasing mild corrugations in the web of cardboard 1*w*. The gap between the cylinders 4 is adjusted such that the ridges 25 do not apply a strong compression to the cardboard against the bottoms of the grooves 25, whereby the cardboard becomes slightly corrugated but does not lose its normal rigidity. However, when the cardboard is folded around a book, the folding progresses along lines parallel to the corrugations and, thus, the package is given a neat appearance and the corners do not form sharp bends which are likely to cause tearing.

Next, the web of cardboard 1*w* travels through scoring cylinders 5 which are provided with annular bosses for pressing the cardboard therebetween to form bending or creasing lines 21. Thus, the axial distance between the scoring rings defines the width of a package blank. An adhesive station 6 is used for applying lengthwise narrow adhesive strips adjacent to the bending lines 21, a folding shoe is used for double-folding an edge 23 and a pair of press cylinders 8 is used for securing the adhesive attachment of the edges 23.

For example, a comb-like adhesive nozzle 9 is used for periodically applying an adhesive onto the web of cardboard 1*w* to form adhesive zones 19, having a width which is equal to that of a package blank, and a web-directed length which does not exceed the corresponding length of the inner wrapper 2*p*. Prior to bringing the web 1*w* in between a pair of folding cylinders 15, the inner wrappers 2*p* are fed onto the web 1*w* in alignment with the adhesive zones 19.

A pair of drawing cylinders 12 is used for continuously drawing a web of inner-wrapper forming paper 2*w* from a roll 2*r*, mounted on a roll housing 2. As shown by reference numeral 10, the paper-web edge sections are folded onto the middle web section for laying edge sections (24, FIG. 4) on top of each other in a overlapping fashion. The folding is completed with cylinders 11 and the folded web of paper is chopped to the width of the inner wrapper 2*p* by means of a crosswise cutting cylinder 13. The chopped inner wrappers are carried forward by means of a stud-chain conveyor 14, whose speed and the distance between studs 14' determine a feeding interval for the inner wrappers 2*p*. The conveyor 14 is horizontal and the web of cardboard 1*w* arrives at the folding cylinders 15 obliquely from below. From the folding cylinders 15, a composite web continues in horizontal direction under the traction of main drawing cylinders 17.

In order to provide a secure alignment of the inner wrappers 2*p* with the adhesive zones 19, the main drawing device 17, the cut-off device 18 and the stud-chain conveyor 14 for the web of cardboard 1*w* are provided with drives synchronized (indicated schematically at 34) with each other by a mechanically coupled transmissions 30, 32 therefor. Thus, no drift can occur even at high production rates. The main drawing cylinders 17 are pulling the web of cardboard 1*w* at a speed which is more than double compared to the paper-web 2*w* drawing speed effected by cylinders 12. This speed ratio determines the ratio of chopping lengths for a sheet of cardboard 1*p* and the inner wrapper 2*p*, which ratio is not highly critical since, by virtue of its flexibility, the paper-made inner wrapper 2*p* does not in any way limit the width of a package to be produced. Thus, the inner wrapper 2*p* can be wider or narrower than a package to be produced and still the outer cardboard 1*p* can always be wrapped tightly around a book or a bundle of books to be packed.

Figure 2:
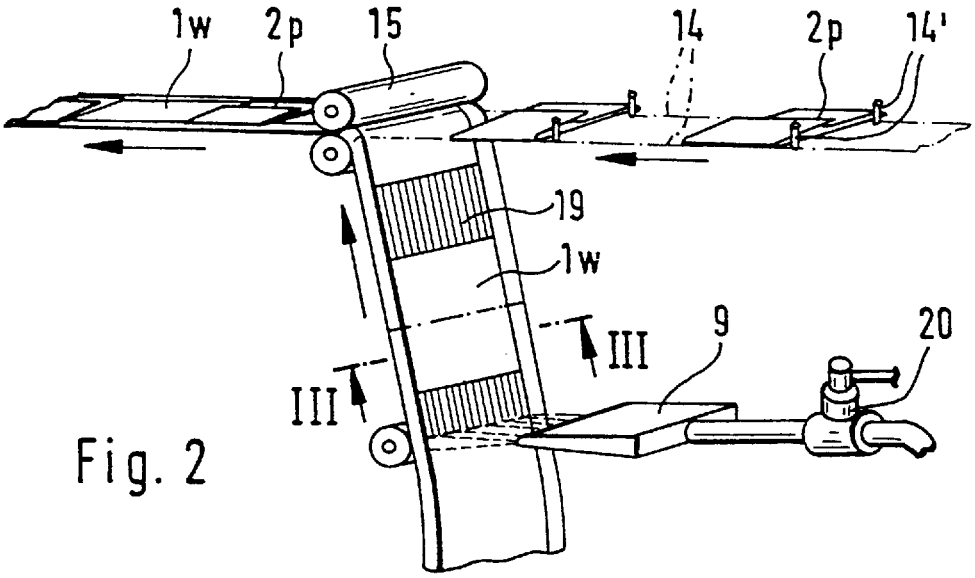
FIG. 2 shows a perspective view of an essential production method sequence for delivering the inner wrapper strips onto the web of cardboard.
Figure 3:
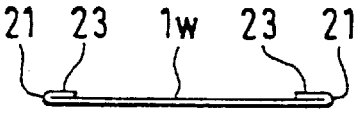
FIG. 3 shows the web of cardboard in a cross-section along a line III—III in FIG. 2.

In order to secure the landing of the adhesive zones 19 in the middle of only subsequently chopped cardboard sheets 1*p*, the periodic action of a valve 20 included in the adhesive nozzle 9 is synchronized with that of the cut-off device 18 such that the cuts are always located in the middle of adhesive-free zones included between the adhesive zones 19 (dash-and-dot line in FIG. 2).

The sizing of inner wrapper strips 2*p* onto the web of cardboard 1*w* is secured by means of press cylinders 16 followed by the main drawing cylinder 17 and the cardboard-web cutting device 18, comprising a sufficiently large cylinder fitted with a transverse blade. The finished package blanks shown in FIG. 4 are stacked and bundled for shipping. The package blank can be used for packing books of varying sizes by means of automatic machines. Known automatic machines for packing books are described in the Patent publications EP 0,273,240, EP 0,378,783 and EP 94,107,559.0.

The embodiments of the invention in which an exclusive property or privilege is claimed are defined as follows:

1. A method for the continuous production of package blanks, wherein a web of cardboard (1*w*) is continuously drawn from a roll (1*r*), guided through a pair of slotted cylinders (4) for providing the web with a mild corrugation, provided with lengthwise scoring lines (21) which are made at a small distance from boil edges of the web (1*w*), lengthwise adhesive strips are applied adjacent to the scoring lines (21), and edges (23) of the web (1*w*) are double-folded along the scoring lines (21), the improvement comprising:

periodically applying an adhesive to a surface of the continuous web of cardboard (1*w*) to provide a series of adhesive zones (19);

folding edge sections (24) of a web of paper (2*w*) on top of a mid-section of the web of paper such that the edge sections (24) overlap on top of each other;

chopping the web of folded paper to form a series of separate inner wrapper strips (2*p*) for each associated one of a series of precision-length package blanks;

delivering each of said series of separate inner wrapper strips onto said web of cardboard (1*w*) in alignment with each associated one of said series of adhesive zones (19) while the web of cardboard (1*w*) is continuously drawn towards a main drawing device (17); and chopping (18) the web of cardboard (1*w*) to produce said series of precision-length package blanks at locations between each one of the series of separate inner wrapper strips (2*p*).

2. A method as set forth in claim 1, wherein the delivery and alignment of the series of separate inner wrapper strips (2*p*) with each associated one of said series of adhesive zones (19) are controlled synchronously with a cut-off device (18) for the web of cardboard (1*w*).

3. A method as set forth in claim 2, wherein the web of paper (2*w*) is pulled from a roll (2*r*) continuously as the web of cardboard (1*w*) is drawn at a speed more than 2 times that of the web of paper.

4. A method as set forth in claim 1, wherein the web of paper (2*w*) is pulled from a roll (2*r*) continuously as the web of cardboard (1*w*) is drawn at a speed more than 2 times that of the web of paper.

5. An apparatus for the continuous production of package blanks, said apparatus comprising a roll housing (1) for a web of cardboard (1*w*), a pair of slotted cylinders (4) for passing the web of cardboard therethrough, a pair of cylinders (5) fitted with scoring discs for producing lengthwise scoring lines (21) adjacent to edges of the web of cardboard, an adhesive station for applying an adhesive adjacent to the scoring lines, a folding shoe (7) for bending edges of the web (1*w*) along the scoring lines (21), a pair of press cylinders (8) for pressing doubled edges (23) of the web of cardboard to the applied adhesive, a main drawing device (17) for continuously drawing the web of cardboard, and a cut-off device (18) downstream of the main drawing device for chopping the web of cardboard (1*w*) to package blanks of a suitable length, the improvement comprising:

an adhesive nozzle (9) downstream of the pair of press cylinders (8) for the application of an adhesive onto the web of cardboard (1*w*) periodically so as to form a series of adhesive zones (19), and aligning and feeding means (14, 14') for delivering each respective one of a series of separate inner wrapper strips (2*p*) onto the web of cardboard (1*w*) in alignment with each associated one of said series of adhesive zones (19).

6. An apparatus as set forth in claim 5, wherein a transmission (30) is provided from the cardboard-web (1*w*) chopping device (18) to a stud-chain conveyor (14, 14') for delivering each respective one of said series of separate inner wrapper strips (2*p*) in alignment with each associated one of said series of adhesive zones (19).

7. An apparatus as set forth in claim 6, wherein the main drawing device (17), the cut-off device (18) and the stud-chain conveyor (14) for the web of cardboard (1*w*) are synchronized with each other so as to provide mechanically coupled transmissions therefor.

8. An apparatus as set forth in claim 6, wherein the periodic action of a valve (20) included in the adhesive nozzle (9) is synchronized with that of the cut-off device (18) such that the cuts are located between each of 1aid series of adhesive zones (19).

9. A method for the continuous production of package blanks, comprising:

drawing a web of cardboard through slotted cylinders having meshing grooves and ridges for corrugating the web;

drawing the web through scoring cylinders having annular bosses for pressing and creasing the cardboard web;

periodically applying an adhesive to a surface of the continuous web of cardboard to provide a series of adhesive zones;

forming scoring lines adjacent edges of the web;

applying an adhesive strip adjacent to each of the scoring lines;

double-folding the edges of the web along the scoring lines;

continuously drawing a web of paper;

folding opposing edges of the web of paper in an overlapping fashion;

cutting the web of paper crosswise to a desired length to form a series of separate inner wrapper strips;

delivering each respective one of said series of inner wrapper strips onto the cardboard web in alignment with each associated one of the series of adhesive zone; and chopping the web of cardboard at locations between each one of the series of inner wrapper strips to form a series of precision-length package blanks.

10. The method of claim 9, wherein the folded lines of each of the series of inner wrapper strips are disposed inwardly toward a center of each cardboard blank away from the folded lines of each of the package blanks.

11. The method of claim 10, wherein the chopped, folded web of paper is conveyed onto the cardboard web by a stud-chain conveyor.

12. The method of claim 11, wherein the delivery and alignment of each respective one of the series of separate inner wrapper strips and alignment of each associated one of the series of adhesive zones are controlled synchronously.

13. The method of claim 12, wherein the periodical application of adhesive onto selected portions of the web to form the series of adhesive zones is synchronized with the supply and alignment of each respective one of the series of separate inner wrapper strips with each associated one of the series of adhesive zones.

* * * * *

UNITED STATES PATENT AND TRADEMARK OFFICE

CERTIFICATE OF CORRECTION

PATENT NO. : 5,772,569
DATED : June 30, 1998
INVENTOR(S) : Veikko Janhonen

It is certified that error appears in the above-identified patent and that said Letters Patent is hereby corrected as shown below:

Abstract, line 2,

After "apparatus" insert --for--.

Column 3, line 6,

"Ir" should be --1r--.

Column 3, line 61,

Delete "a".

Column 4, line 37, Claim 1, line 6,

"boil" should be --both--.

Column 5, line 44, claim 8, line 3,

"laid" should be --said--.

Signed and Sealed this
Fifth Day of January, 1999

*Attest:*

*Attesting Officer*

*Acting Commissioner of Patents and Trademarks*